US012227857B2

(12) United States Patent
Arimoto et al.

(10) Patent No.: US 12,227,857 B2
(45) Date of Patent: Feb. 18, 2025

(54) METAL SULFATE MANUFACTURING SYSTEM VIA ELECTROCHEMICAL DISSOLUTION

(71) Applicant: Tesla, Inc., Palo Alto, CA (US)

(72) Inventors: Shinji Arimoto, San Jose, CA (US); Mikel Dermer, Santa Clara, CA (US); Zhiwen Sun, Sunnyvale, CA (US)

(73) Assignee: Tesla, Inc., Austin, TX (US)

( * ) Notice: Subject to any disclaimer, the term of this patent is extended or adjusted under 35 U.S.C. 154(b) by 0 days.

(21) Appl. No.: 17/264,505

(22) PCT Filed: Aug. 1, 2019

(86) PCT No.: PCT/US2019/044720
§ 371 (c)(1),
(2) Date: Jan. 29, 2021

(87) PCT Pub. No.: WO2020/028698
PCT Pub. Date: Feb. 6, 2020

(65) Prior Publication Data

US 2021/0230757 A1 Jul. 29, 2021

Related U.S. Application Data

(60) Provisional application No. 62/713,702, filed on Aug. 2, 2018.

(51) Int. Cl.
*C25B 11/089* (2021.01)
*C25B 1/01* (2021.01)
(Continued)

(52) U.S. Cl.
CPC ..... *C25B 11/089* (2021.01); *C25B 1/01* (2021.01); *C25B 9/17* (2021.01); *C25B 11/02* (2013.01);
(Continued)

(58) Field of Classification Search
CPC ..... C25B 11/02; C25B 11/089; C25B 1/01; C25B 9/17; C25B 11/063; C25B 15/033; C25B 15/085; C25C 11/08
See application file for complete search history.

(56) References Cited

U.S. PATENT DOCUMENTS 2,913,378 A * 11/1959 Dean ..... C25C 3/28 205/347
3,983,018 A * 9/1976 Borbely ..... C25C 1/08 205/771
(Continued)

FOREIGN PATENT DOCUMENTS

CN 104451784 A * 3/2015 ..... C25C 7/00
DE 3546039 A1 * 7/1987 ..... C25C 1/12
(Continued)

OTHER PUBLICATIONS

International Search Report and Written Opinion dated Oct. 7, 2019 in application No. PCT/US2019/044720.

*Primary Examiner* — Ciel P Contreras
(74) *Attorney, Agent, or Firm* — Knobbe Martens Olson & Bear LLP

(57) ABSTRACT

A metal sulfate manufacturing system comprising an electrochemical dissolution system having, an anode electrode that holds metal raw material, a cathode electrode, an electrolyte bath having an inlet to receive an initial acid or metal-acid complex solution and an outlet to discharge the treated metal sulfate solution, stirring equipment that mixes the electrolyte bath, a temperature control system, and a rectifier that supplies current at constant voltage between the anode and cathode electrode.

25 Claims, 13 Drawing Sheets

(51) Int. Cl.

| | |
|---|---|
| ***C25B 9/17*** | (2021.01) |
| ***C25B 11/02*** | (2021.01) |
| ***C25B 11/063*** | (2021.01) |
| ***C25B 15/033*** | (2021.01) |
| ***C25B 15/08*** | (2006.01) |

(52) U.S. Cl.
CPC ..... *C25B 11/063* (2021.01); *C25B 15/033* (2021.01); *C25B 15/085* (2021.01)

(56) References Cited

U.S. PATENT DOCUMENTS

| | | | | |
|---|---|---|---|---|
| 4,039,403 | A * | 8/1977 | Astley | C25C 7/02 204/287 |
| 4,242,192 | A | 12/1980 | Chambers et al. | |
| 4,639,297 | A * | 1/1987 | Suematsu | C01B 32/10 205/460 |
| 5,650,053 | A * | 7/1997 | Gay | C25C 7/06 204/227 |
| 6,409,895 | B1 * | 6/2002 | Ponzano | C25B 9/19 204/260 |
| 2002/0189953 | A1 * | 12/2002 | Wang | C22B 23/06 204/252 |
| 2006/0091017 | A1 * | 5/2006 | Lam | C25C 5/02 204/280 |
| 2007/0158196 | A1 * | 7/2007 | Kang | C25C 7/025 205/48 |
| 2011/0089045 | A1 | 4/2011 | Cardarelli | |
| 2016/0319444 | A1 * | 11/2016 | Moskovchenko | C25B 9/17 |
| 2017/0009358 | A1 * | 1/2017 | Shin | C22B 23/043 |

FOREIGN PATENT DOCUMENTS

| | | | | |
|---|---|---|---|---|
| EP | 0 221 685 | | 5/1987 | |
| FR | 2692880 | A1 * | 12/1993 | C01G 43/066 |
| JP | 62-256975 | | 11/1987 | |
| JP | 05-059582 | | 3/1993 | |
| JP | 2003-096585 | | 4/2003 | |
| JP | 4593038 | | 12/2010 | |

* cited by examiner

Prior Art

Prior Art

Prior Art

Prior Art

METAL SULFATE MANUFACTURING SYSTEM VIA ELECTROCHEMICAL DISSOLUTION

INCORPORATION BY REFERENCE TO ANY PRIORITY APPLICATIONS

This application claims the benefit of PCT Patent Application No. PCT/US2019/044720, filed Aug. 1, 2019, entitled "METAL SULFATE MANUFACTURING SYSTEM VIA ELECTROCHEMICAL DISSOLUTION" and U.S. Provisional Patent Application No. 62/713,702, filed Aug. 2, 2018, entitled "METAL SULFATE MANUFACTURING SYSTEM VIA ELECTROCHEMICAL DISSOLUTION", each of which are hereby incorporated by reference in their entirety.

BACKGROUND

Field

The present disclosure generally relates to the synthesis of metal-sulfate solutions, in particular metal-sulfate from raw, metal materials.

Description of the Related Art

Nickel and cobalt sulfates are often used as raw materials for lithium-ion battery cathode material precursors, nickel metal hydride battery cathodes, and nickel cadmium battery cathodes. It is sometimes difficult or expensive to purchase metal sulfate products from the market due to their limited availability. As a result, several companies synthesize metal sulfate solutions via dissolution in sulfuric acid from more readily available metal products, such a nickel powder, nickel briquette, cobalt powder, and cobalt briquette. However, the growth of the electric and hybrid-electric vehicle markets is expected to continue into the future and result in a shortage of metal powders and briquettes, in addition to sulfates.

The metal cathode market is larger than the metal powder and briquette markets making it easier to acquire metal cathode materials. However, metal cathodes can be difficult to dissolve using sulfuric acid, especially dilute sulfuric acid, because cathodes have significantly less surface area that is exposed to the acid, as compared to metal powder and briquette forms.

Current methods exist for metal dissolution by sulfuric acid using high temperature, high pressure, and high sulfuric acid concentration. However, these methods require expensive equipment and additional safety measures as dissolution at high pressures and acid concentrations is inherently more dangerous. Additionally, it is difficult to consume residual acid in the metal sulfate solution made via sulfuric acid dissolution using conventional methods without long reaction times. High residual acid levels are undesirable for subsequent processing and necessitate added pretreatment steps.

SUMMARY

One embodiment is an electrochemical dissolution system and method for manufacturing aqueous metal (nickel, cobalt, manganese, etc.) sulfate solutions from various metal products (cathode, briquette, powder, etc.) using a relatively dilute sulfuric acid. In this embodiment an electrochemical dissolution device having an anode and a cathode is used, along with an acid solution, to synthesize a metal sulfate solution from metal cathodes, powders, or briquette raw materials. In some embodiments, the electrochemical dissolution system allows the user to use relatively low concentrations of sulfuric acid compared with conventional methods and leads to the resultant meal sulfate solution having a lower residual sulfuric acid concentration that prior systems.

In one aspect, an electrochemical dissolution system for dissolving raw metal materials is described. The system includes an electrolyte bath container having an inlet, an outlet, a temperature control system, and configured to hold an electrolyte solution. The system further includes a liquid permeable anode electrode disposed within the bath container. The system further includes a cathode electrode surrounding the liquid permeable anode electrode. The system further includes a power supply electrically connected to the liquid permeable anode electrode and cathode electrode. In some embodiments of the system, the cathode electrode surrounds the liquid permeable anode electrode equidistantly on all sides. In some embodiments, the system further comprises an agitator configured to agitate electrolyte within the bath container.

In some embodiments, the liquid permeable anode electrode comprises a basket-type shape, a sandwich-type shape, or a tray-type shape. In some embodiments, the liquid permeable anode electrode comprises at least one of platinum, platinum coated-titanium, and iridium coated-titanium. In some embodiments, the system further comprises a metal raw material submerged within the electrolyte bath and held by the liquid permeable anode electrode. In some embodiments, the metal raw material comprises at least one of a nickel cathode, a nickel briquette, a cobalt cathode, and a cobalt briquette. In some embodiments, the liquid permeable anode electrode comprises an anode electrode body comprising at least one of a mesh type material and a punched type material.

In some embodiments, the cathode electrode comprises at least one of platinum, platinum coated nickel, and nickel. In some embodiments, the cathode electrode comprises a cathode electrode body comprising at least one of a corrugated-type material, a sponged-type material, and an embossed-type material.

In some embodiments, the electrolyte bath container comprises an electrolyte. In some embodiments, the electrolyte comprises an acid. In some embodiments, the acid is sulfuric acid. In some embodiments, the acid concentration is between about 1M and about 3M. In some embodiments, the electrolyte bath agitator comprises at least one of a mechanical agitator, a magnetic stirrer, a liquid circulator, and an air agitator.

In another aspect, a method of using the electrochemical dissolution system is described. The method includes applying a voltage between the liquid permeable and anode electrode and the cathode electrode, providing a fresh electrolyte solution to the electrolyte bath container through the inlet, and withdrawing a processed solution from the electrolyte bath container through the outlet.

In some embodiments of the method, the fresh electrolyte solution has a metal concentration less than the processed solution. In some embodiments, the method further comprises controlling the temperature of the electrolyte bath container to between about 35° C. and about 60° C. using the temperature control system. In some embodiments, applying a voltage between about 2.0 V to about 3.5 V. In some embodiments, applying a voltage between about 0.1 V to about 1 V.

Figure 1:
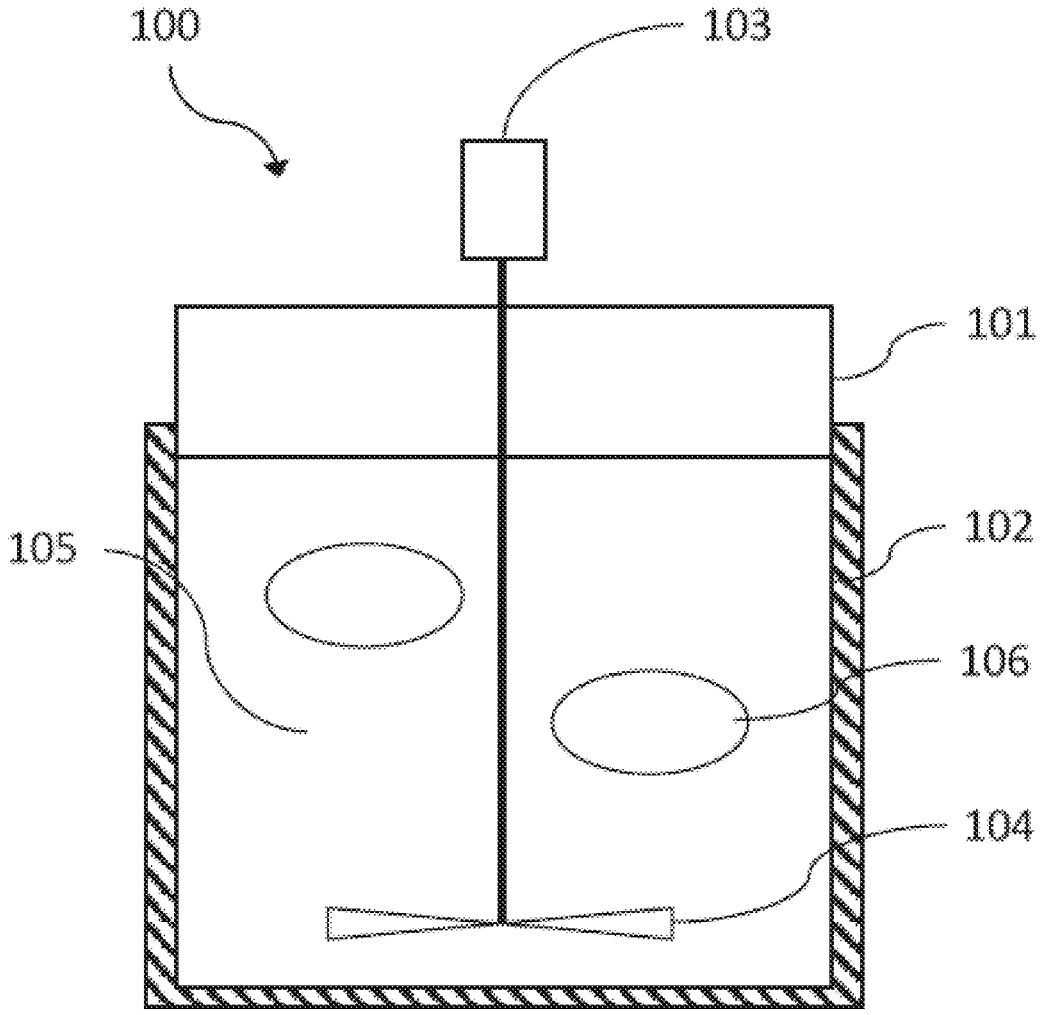
FIG. 1 illustrates a prior art system for dissolving solid metal material into concentrated acid solution.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting it.

Figure 10:
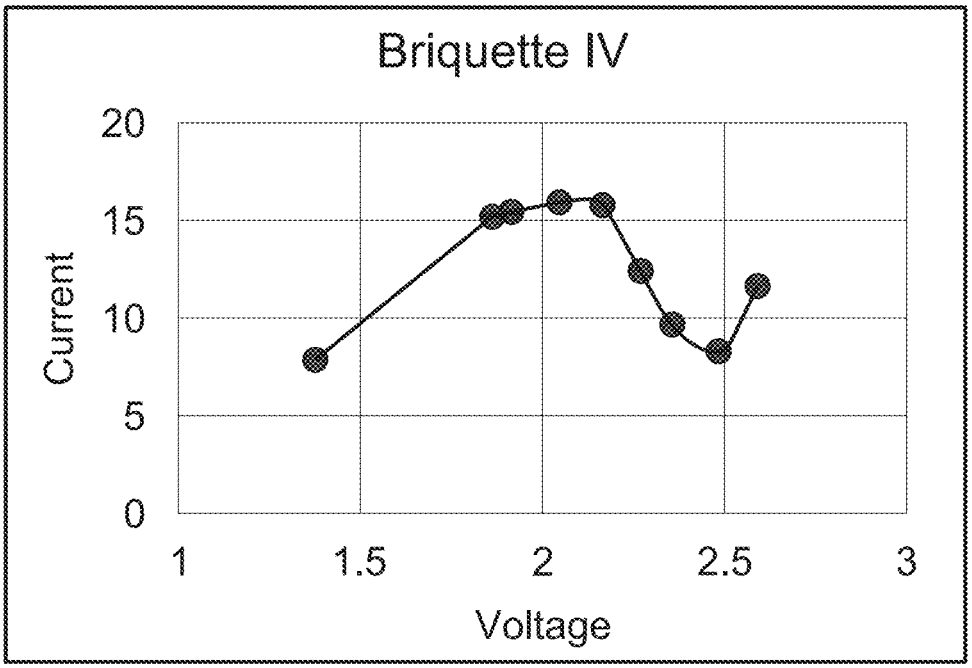

FIG. 10 is a chart showing the current v. voltage of a Ni briquette dissolved using an embodiment of the disclosed system.

Figure 11:
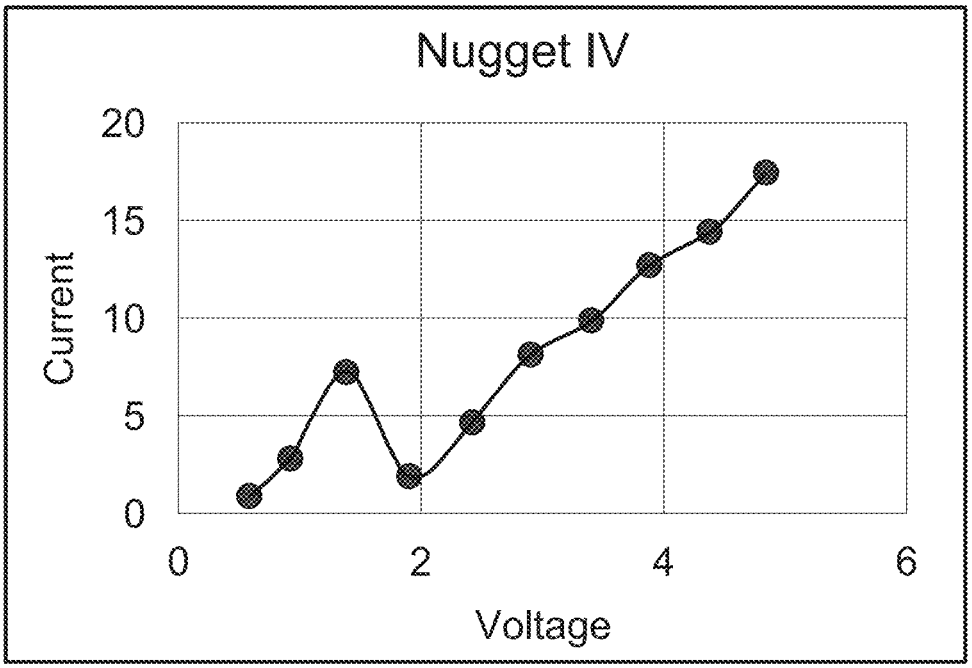

FIG. 11 is a chart showing the current v. voltage of a Ni cathode nugget dissolved using an embodiment of the disclosed system.

Figure 12:
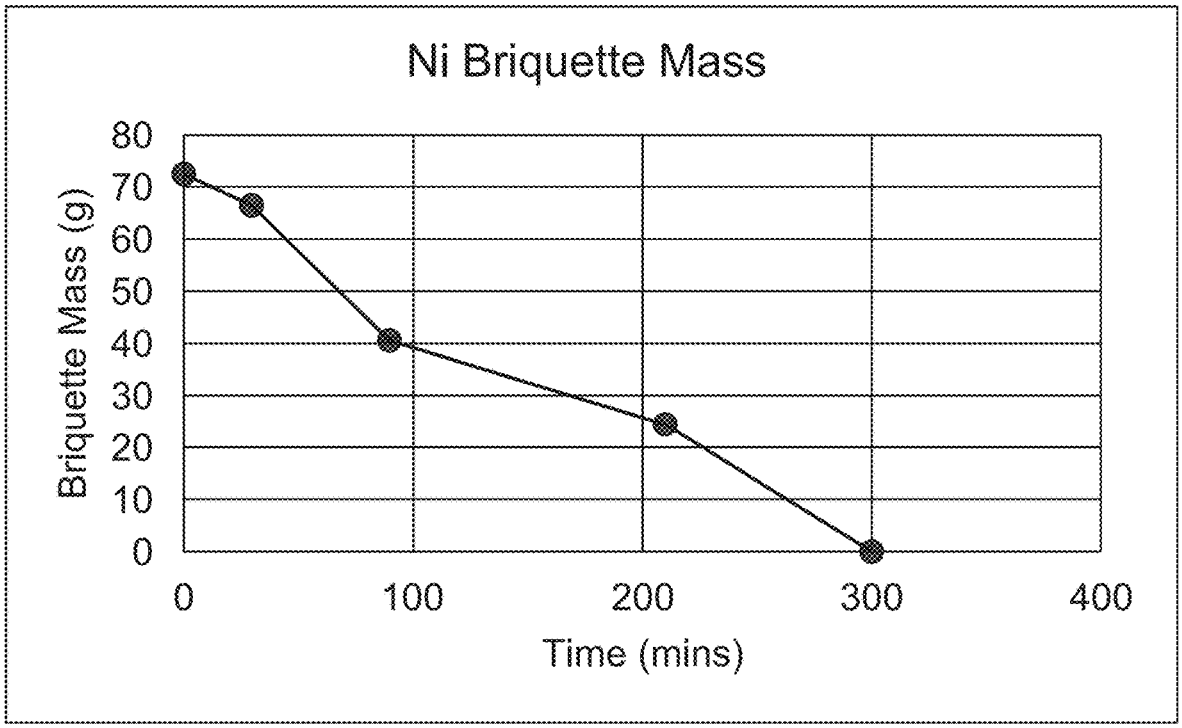

FIG. 12 is a chart showing the dissolution of a Ni briquette using an embodiment of the disclosed system.

Figure 13:
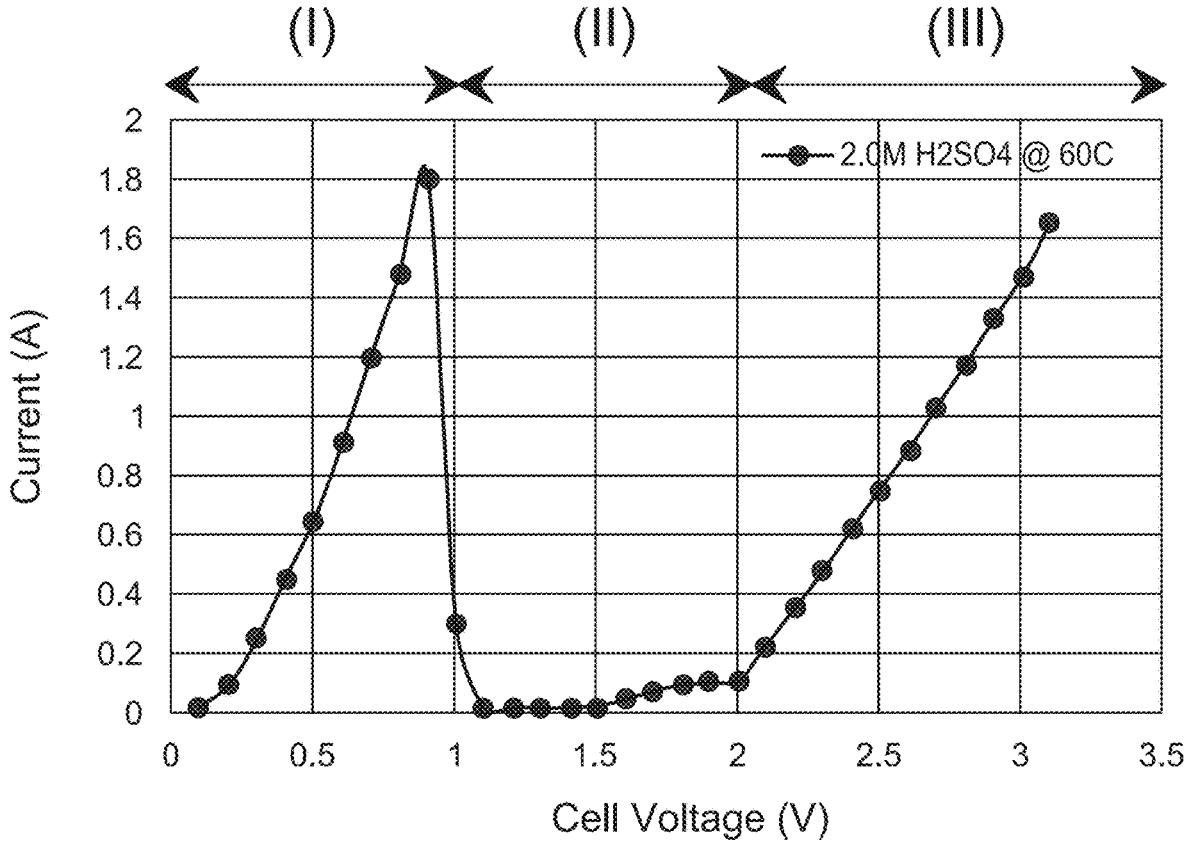

FIG. 13 is a chart showing the current v. voltage characteristics for Ni electrochemical dissolution using an embodiment of the disclosed system with a 2 M sulfuring acid electrolyte solution at 60° C.

DETAILED DESCRIPTION

This present disclosure describes a manufacturing system and method for synthesizing metal sulfate solutions from metal raw materials. This can be used as part of a recycling process wherein the metal raw materials are obtained from parts such as expended battery cathodes. The metal raw materials may include nickel cathodes, nickel briquettes, cobalt cathodes, and cobalt briquettes, with improved process costs and reaction times compared to conventional methods. The present disclosure also describes an electrochemical dissolution system that is used to for manufacturing aqueous metal (nickel, cobalt, manganese, etc.) sulfate solution taken from the metal raw materials.

In one embodiment, the electrochemical dissolution system includes an anode that is electrically connected to a cylindrical basket for holding the metal raw materials. A cylindrical cathode is configured to surround the anode basket at a predetermined distance from the anode, for example wherein the cathode comprises a cylindrical shape with a slightly larger diameter than the cylindrical basket connected to the anode. The anode and cathode are submerged into a weak acidic formulation, such as sulfuric acid, and an electrical potential is placed across the anode and cathode. The electrical potential helps break down the raw metal materials within the anode basket, while the acidic formulation may be flowed across the raw materials to further cause digestion of the raw metal materials to form an aqueous metal sulfate solution. Using this configuration allows a lower concentration of sulfuric acid to be flowed across the raw metal materials and utilized compared to conventional methods, resulting in weaker residual sulfuric acid concentrations after treatment.

Embodiments of the electrochemical dissolution system separate the anode and/or cathode electrical connection from the raw metallic materials by placing the raw materials in a basket and not directly connecting the raw metal materials to the electrodes. This offers a practical and cost-efficient method for electrochemical metal dissolution without risking a contact disconnect between the metal material and electrical lead while the metal material is being digested within the acidic solution.

In some embodiments, the anode electrode may be formed of, or electrically connected to, a body that holds the metal raw material. The body may be a basket, and can be liquid permeable so that the liquid may pass through the anode electrode from an outside portion of the electrode to an inside portion of the electrode. In some embodiments, the liquid is as aqueous and/or organic solution. In some embodiments, the liquid permeable anode electrode is shaped or configured to hold a metal raw material on the inside portion of the electrode. In some embodiments, the liquid permeable anode electrode is shaped in a basket-type shape, a sandwiching-type shape, or tray-type shape. In some embodiments, the liquid permeable anode electrode comprises a body that is at least one of at a mesh type body and a punched metal type body. In some embodiments, the liquid permeable anode electrode is shaped as a cylindrical, cubic, triangular or other geometric mesh basket, or a similar vessel. In some embodiments, the anode electrode comprises an insoluble material, which is chemically and electrically inert during operation of the system. In some embodiments, the anode electrode is structured to physically hold or submerge the metal raw material in a solution while supplying current until metal raw material is essentially or perfectly dissolved. In some embodiments, the anode electrode comprises or is formed from at least one of platinum, platinum-coated titanium, or iridium oxide-coated titanium.

A cathode electrode of the system is positioned to surround the anode electrode in one embodiment. In some embodiments, the cathode electrode partially, substantially or entirely surrounds the anode electrode. In some embodiments, the cathode electrode partially, substantially or entirely surrounds the surface area of the anode electrode. In some embodiments, the cathode electrode surrounds greater than or greater than about 50%, 75%, 80%, 90%, 95%, 97%, 98% or 99%, of the anode electrode, or any range of values therebetween. In some embodiments, the cathode electrode surrounds the anode electrode equidistantly, such that adjacent positions of the cathode and anode electrodes are at the same or substantially the same distances. For example, the cathode may have a cylindrical shape of a slightly larger diameter than a cylindrical anode. In some embodiments, the cathode electrode is equidistant from the anode electrode at distance of or of about 1 mm, 2 mm, 3 mm, 4 mm, 5 mm, 6 mm, 7 mm, 8 mm, 9 mm, 1 cm or 2 cm, or any range of values therebetween. In some embodiments, the cathode electrode comprises an insoluble metal that is chemically and electrically inert during operation of the system. In some embodiments, the cathode electrode comprises the same metal that is dissolved from the metal raw material during operation of the system. In some embodiments, the cathode electrode has a relatively high surface area to maximize current densities during operation. In some embodiments, the surface area of the cathode electrode is or is about 50 $cm^2$, 75 $cm^2$, 95 $cm^2$, 100 $cm^2$, 150 $cm^2$, 200 $cm^2$, 300 $cm^2$, 400 $cm^2$, 500 $cm^2$, 1000 $cm^2$, 2000 $cm^2$ or 5000 $cm^2$, or any range of values therebetween. In some embodiments, the surface area of the cathode electrode is or is about 1 $m^2$, 5 $m^2$, 10 $m^2$, 25 $m^2$, 50 $m^2$, 75 $m^2$, 95 $m^2$, 100 $m^2$, 150 $m^2$, 200 $m^2$, 300 $m^2$, 400 $m^2$, 500 $m^2$, 1000 $m^2$, 2000 $cm^2$ or 5000 $m^2$, or any range of values therebetween. It is to be understood that the surface area of the cathode electrode will scale by the system size and production capacity. In some embodiments, the cathode electrode comprises at least one of platinum, platinum-coated metal, cobalt, and nickel. In some embodiments, the cathode electrode comprises a body that is at least one of a corrugated sheet type body, a sponged metal type body, and an embossed metal type body. In some embodiments, the cathode electrode is a liquid permeable cathode electrode.

The electrochemical dissolution system may comprise an electrolyte solution. In some embodiments, the electrolyte comprises at least one of an acid and a metal sulfate. In some embodiments, the acid is selected from at least of sulfuric acid, phosphoric acid, nitric acid, hydrochloric acid, hydrobromic acid, hydroiodic acid, perchloric acid and chloric acid. In some embodiments, the electrolyte comprises a dilute sulfuric acid solution or a dilute metal sulfate solution. In some embodiments, the electrolyte comprises an acid concentration, such as sulfuric acid, of or of about 0.1 M, 0.25 M, 0.5 M, 0.75 M, 1 M, 1.25 M, 1.5 M, 1.75 M, 2 M, 2.25 M, 2.5 M, 2.75 M, 3 M, 3.5 M, 4 M and 5 M, or any range of values therebetween. In some embodiments, the electrolyte solution comprises a sulfuric acid concentration between or between about 1 M and 3 M.

In one embodiment, the electrochemical dissolution system comprises a fluid inlet to provide a fresh electrolyte solution, and an outlet to withdraw a processed electrolyte solution from the system. In some embodiments, the system is run as a continuous system wherein the fresh electrolyte solution (for example, such as sulfuric acid or a dilute metal sulfate solution) is continuously flowed into the electrochemical dissolution system through the fluid inlet and admixed with the existing electrolyte solution within the system. In some embodiments, the electrolyte within the electrochemical dissolution system is held by an electrolytic bath container that surrounds the anode and cathode components. The processed solution (for example, such as the concentrated product metal sulfate solution) may be continuously discharged from the electrochemical dissolution system as new electrolyte solution is added through the fluid inlet.

In some embodiments, the fresh electrolyte solution comprises a dilute sulfuric acid solution or dilute metal sulfate solution. In some embodiments, the processes solution comprises a concentrated metal sulfate solution. In some embodiments, the inlet and/or the outlet have a flow rate of or of about 5 mL/hr, 10 mL/hr, 15 mL/hr, 20 mL/hr, 25 mL/hr, 30 mL/hr, 50 mL/hr, 100 mL/hr or 1000 mL/hr, or any range of values therebetween. In some embodiments, the inlet and/or the outlet have a flow rate of or of about 1 $m^3$/hr, 5 $m^3$/hr, 10 $m^3$/hr, 15 $m^3$/hr, 20 $m^3$/hr, 25 $m^3$/hr, 30 $m^3$/hr, 50 $m^3$/hr, 100 $m^3$/hr or 1000 $m^3$/hr, or any range of values therebetween. It is to be understood that the flow rate will be configured based on the system size and production capacity. In some embodiments, the fresh electrolyte solution (for example, such as the dilute initial metal sulfate or sulfuric acid solution) has a metal concentration less than the processed solution (for example, such as the final treated metal solution).

In one embodiment, the electrochemical dissolution system comprises an electrolyte bath container that contains the anode electrode, cathode electrode, and electrolyte solution. In some embodiments, the electrolyte bath container comprises an insoluble material that is chemically and electrically inert during operation of the system. In some embodiments, the electrolyte bath container comprises at least one of a plastic, glass, or glass coated metal materials that are resistant to degradation from the acidic electrolyte solution.

The system may comprise a temperature control system to control the electrolyte solution temperature. A temperature control system may allow for higher current efficiencies and a more stable operation of the electrochemical dissolution system. In some embodiments, the temperature control system controls the electrolyte solution temperature in the electrolytic bath to or to about 20° C., 23° C., 25° C., 30° C., 35° C., 40° C., 45° C., 50° C., 55° C., 60° C., 65° C., 70° C., 80° C., 90° C. and 100° C., or any range of values therebetween. For example, in some embodiments, the temperature control system controls the electrolyte solution temperature in the electrolytic bath between or between about 35° C. and 60° C.

The system may comprise an electrolyte bath agitator. In some embodiments, the agitator may comprise stirring equipment. In some embodiments, the stirring equipment may comprise at least one of a mechanical agitator, a magnetic stirrer, a liquid circulator, and an air agitator. The agitator may be used to continuously mix the electrolyte solution and/or to remove bubbles generated during operation from the surface of the anode and/or cathode electrodes. Electrochemical dissolution may form hydrogen and oxygen gases on the surfaces of the electrodes, which may impede current density. Physically removing gas bubbles from the electrodes with the agitator may help accelerate the dissolution reaction to form the more concentrated metal sulfate solution. In some embodiments, the agitator comprises an insoluble material, which is chemically and electrically inert during operation of the system.

The system may comprise a power supply electrically connected to the anode and cathode electrodes. In some embodiments, the power supply can provide a constant voltage and/or amperage. In some embodiments, the power supply can provide a variable voltage and/or amperage. In some embodiments, the power supply is a rectifier, which can supply current with constant voltage between the anode and cathode electrode. In some embodiments, the power applies a voltage at or at about greater than 0 V, 0.1 V, 0.2 V, 0.3 V, 0.4 V, 0.5 V, 0.6 V, 0.7 V, 0.8 V, 0.9 V, 1 V, 1.5 V, 2 V, 2.2 V, 2.4 V, 2.5 V, 2.6 V, 2.8 V, 3 V, 3.5 V, 4 V and 5 V, or any range of values therebetween. For example, in some embodiments, the power supply (for example, such as the rectifier) applies a voltage between or between about 2.0 V to 3.5V. As an additional example, in some embodiments, the power supply (for example, such as the rectifier) applies a voltage between or between about 0.1 V to 1 V.

The metal raw material, in some embodiments in contact with the anode electrode, may be dissolved and ionized by the applied voltage during operation of the system. The cathode electrode generates hydrogen gas from hydrogen ions and electrons created by the applied voltage. In some embodiments, as a result, metal sulfate is generated from the metal raw material and the diluted sulfuric acid as given by the reactions below (in the case of nickel and sulfuric acid).

Overall reaction: $Ni+H_2SO_4 \rightarrow NiSO_4+H_2$

Anode: $Ni \rightarrow Ni^{2+}+2e^-$

Cathode: $2H^++SO_4^{2-}+2e^- \rightarrow H_2+SO_4^{2-}$

In some embodiments, the present disclosure provides a system and method used to dissolve a metal in an acidic solution, wherein the anode is not dissolved chemically or electrochemically during operation and provides continuous electrical contact to the metal material. Stirring or agitation removes gas buildup on the electrode surfaces, provides uniform ion concentrations, and prevents localized concentration buildups inside of the anode electrode. The temperature control system can provide the optimal temperature for the electrolyte and operation to maximize the dissolution reaction rate. In some embodiments, the operating parameters of the system are configured to minimize the residual acid amount.

Embodiments of the present disclosure can produce relatively high concentration metal sulfate solutions while minimizing the residual sulfuric acid concentration, making it highly desirable for subsequent processing. In some embodiments, the electrolyte comprises a metal sulfate concentration of or of about 0.1 M, 0.25 M, 0.5 M, 0.75 M, 1 M, 1.25 M, 1.5 M, 1.75 M, 2 M, 2.25 M, 2.5 M, 2.75 M, 3 M, 3.5 M, 4 M and 5 M, or any range of values therebetween. Furthermore, some embodiments of the present disclosure can use more dilute sulfuric acid as a sulfate source compared to conventional methods, making additional acid concentration pretreatment steps unnecessary. Furthermore, some embodiments of the present disclosure requires shorter reaction time compared with conventional sulfuric acid dissolution, thereby allowing smaller and more cost-effective equipment sizes. Furthermore, some embodiments of the present disclosure improve upon the safety of conventional sulfuric acid dissolution systems and do not require high temperature, high acid concentration, and/or high pressure during operation of the system. Furthermore, embodiments of the present disclosure can maintain the current load until metal dissolution has completed, as opposed to conventional electrochemical dissolution methods where the electrical supply is interrupted after the metal material preferentially dissolves from the lead.

Prior Systems

FIG. 1 illustrates a prior art system 100 for dissolving solid metal raw material 106 into concentrated acid solution 105. The system of FIG. 1 includes an electrolytic bath container 101, a temperature control system 102, a stirring apparatus 103, a corresponding impeller 104, concentrated acid solution 105, and metal raw material 106. The system 100 illustrated in FIG. 1 operates in the absence of an electrical driving force which would aid the dissolution of the solid metal raw material 106.

The system 100 of FIG. 1 operates by solubilizing solid metal raw material 106 via chemical acid leaching, a process in which solid metals diffuse into a solvent bath under favorable pressure, temperature, agitation, and acid concentration conditions. Sulfuric acid is used as the leaching solvent due to its strong tendency to oxidize metals via a single displacement reaction, producing hydrogen gas and metal sulfate species as reaction products. The temperature control system 102 allows for the setting of higher temperatures to increase the chemical reaction rate and solubility limit for the metal salt species. The stirring apparatus 103 can provide agitation via impeller 104 to increase the chemical reaction rate.

Within the operation of system 100 of FIG. 1, the concentrated acid or metal-acid complex solution 105 converts the solid metal material to soluble metal salt species and releases hydrogen gas as a byproduct. The initial acid or metal-acid complex solution becomes more metal-rich over the course of operation as the initial raw metal material is converted to soluble metal salts in the presence of high temperatures, pressures, agitation rates, and acid concentrations. The high pressures and acid concentrations typically used necessitate additional measures to safely operate the reactor vessel and prevent chemical exposure.

Figure 2:
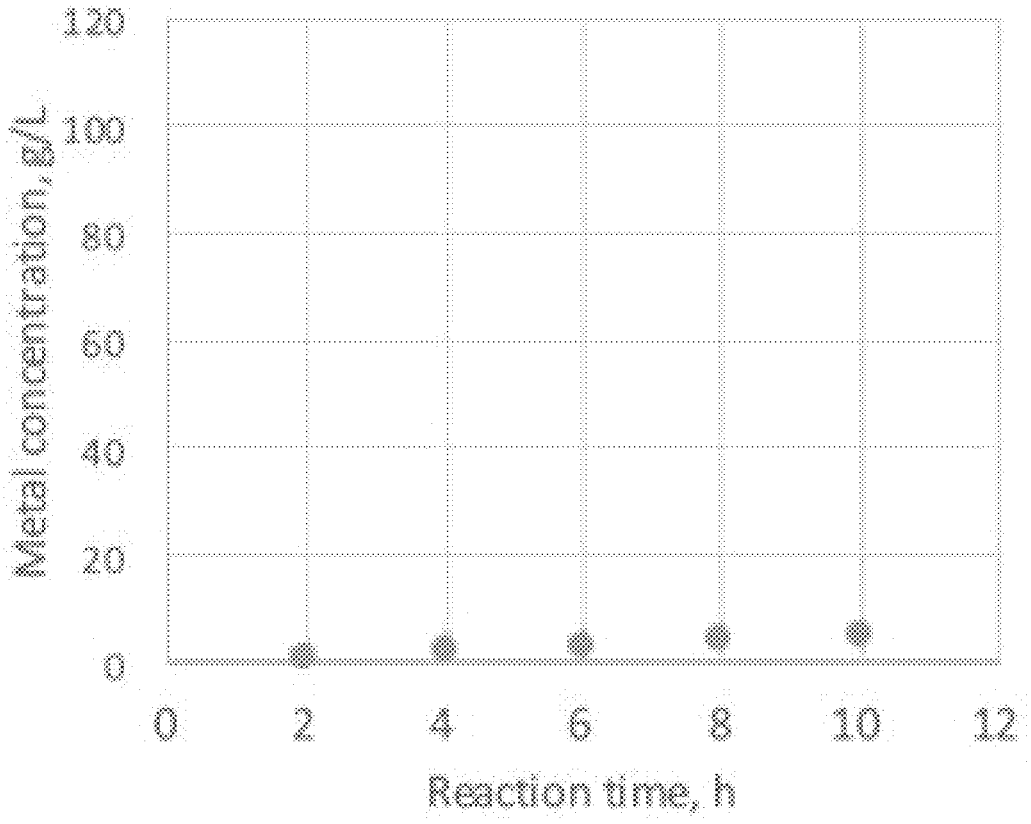
FIG. 2 illustrates typical results of prior art system when low surface area metal materials such as metal cathode are used as the raw metal material.

FIG. 2. illustrates typical results found in the prior art system 100 when low surface area metal materials such as metal cathodes are used as the metal raw material 106, and show metal concentrations solubilized into the concentrated acid solution 105 over the operating time of the system 100. Due to low surface area of the metal cathode, the metal dissolution rate is relatively low and the resulting solubilized metal concentration in solution increases slowly as a function of time. The solubility limit of metal species in acidic solutions typically varies between 100 g/L and 400 g/L depending on the type of metal-salt complex formed, reaction pressures used, and reaction temperatures used. However, the system 100 generally does not achieve higher than 10 g/L without extremely long reaction times as illustrated in FIG. 2. As such, not all of the low surface area metal material is able to be chemically leached into the electrolyte solution due to the extremely long reaction times required.

Figure 3:
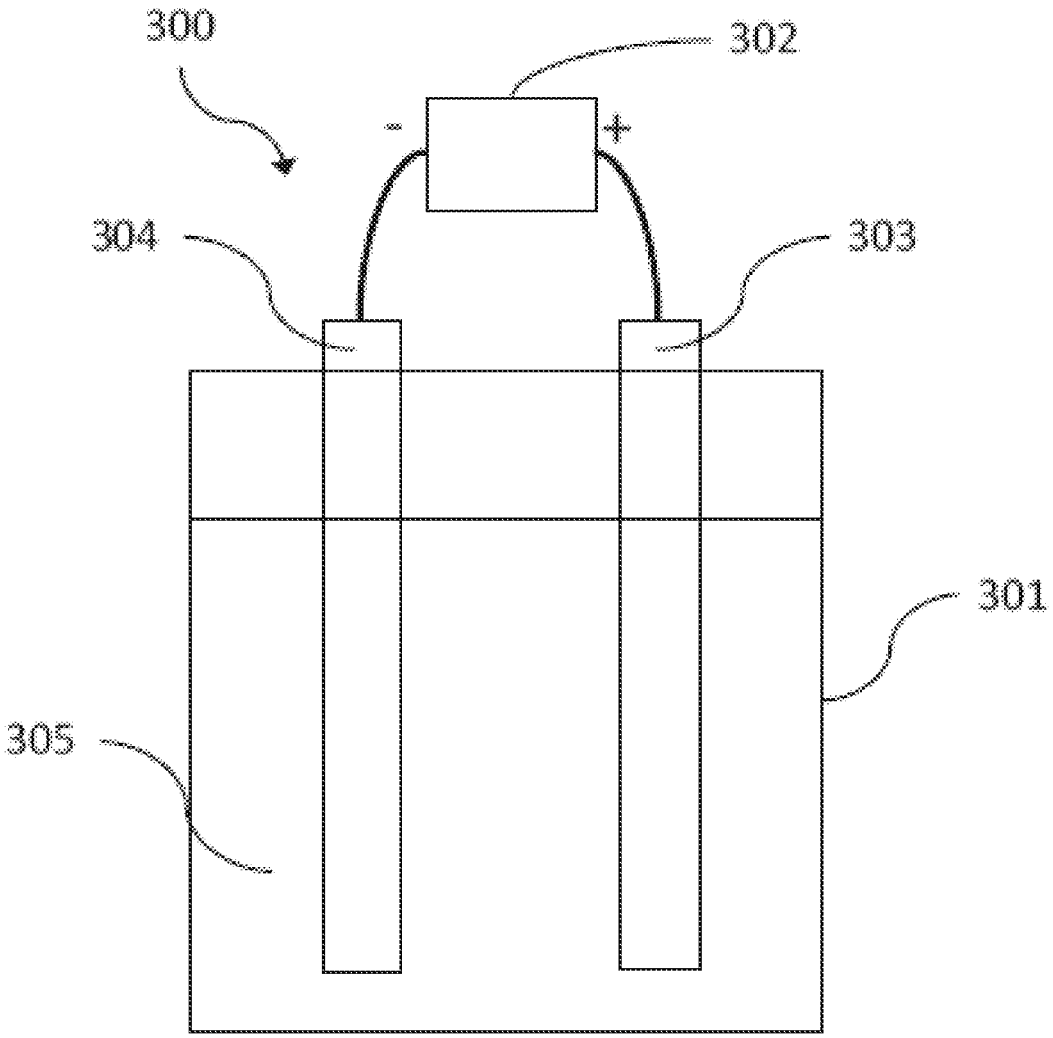
FIG. 3 illustrates a prior art system for dissolving solid metal material/anode into concentrated acid solution under the presence of an applied electrical field generated by power supply.

FIG. 3 illustrates another prior art system 300 for dissolving solid metal material/anode 303 into a concentrated acid solution 305 under the presence of an applied electrical field generated by power supply 302. The system of FIG. 3 includes an electrolytic bath container 301, a power supply 302, solid metal material/anode electrode 303, a cathode electrode 304, and a concentrated acid solution 305. The solid metal material/anode electrode 303 is positively charged and collects electrons emitted by its oxidation under an applied potential. The cathode electrode 304 is negatively charged and releases electrons by reducing hydrogen ions in solution to form hydrogen gas.

The system 300 of FIG. 3 operates by solubilizing the solid metal material/anode electrode 303 via metal anodic dissolution, whereby the slow but otherwise spontaneous process of chemical dissolution is driven aggressively by the application of an applied electrical potential between solid metal material/anode electrode 303 and cathode electrode 304 which are submerged into a concentrated acid solution 305. Within the system 300 of FIG. 3, the applied electric field between solid metal material/anode electrode 303 and cathode electrode 304 pulls negatively charged acid counter ions (such as $SO_4^{2-}$) towards the solid metal material/anode electrode 303 where they join with $M^{2+}$ (M=metal, such as Ni, Co, etc.) ions generated by the oxidation of the solid metal material/anode electrode 303. Electrons generated at the solid metal material/anode electrode 303 are driven to the cathode electrode 304 through power supply 302 where they join with hydrogen ions to form hydrogen gas.

Within the operation of system 300 of FIG. 3, the electrical potential created by power supply 302 drives the conversion of the solid metal material/anode 303 into soluble metal salt species and releases hydrogen gas as a byproduct. The initial acid or metal-acid complex solution 305 becomes more metal-rich over the course of operation as the solid metal material/anode electrode 303 is converted into soluble metal salts in the presence of an electric field. Higher potentials are typically used to drive the reaction rate, although the metal dissolution reaction begins to compete with water electrolysis at 1.23V.

Figure 4:
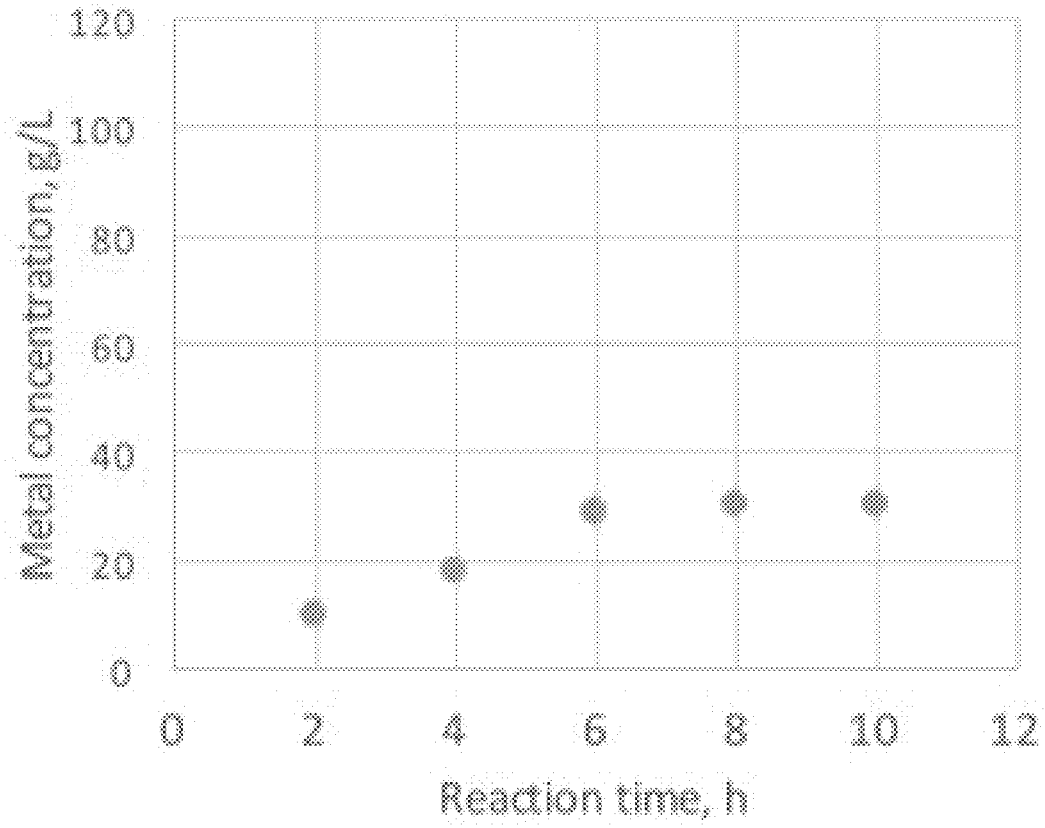
FIG. 4 illustrates typical results of prior art system when low surface area metal materials such as solid metal cathode are used as the anode electrode.

FIG. 4. illustrates typical results found from a system 300 when low surface area metal materials, such as solid metal cathode materials, are used within the system 300. Although at first the metal concentration increases in solution as a function of time, the reaction rate beings to slow before halting due to a loss of electrical contact between the solid metal material/anode electrode 303 and the power supply 302. This loss of contact is a result of the solid metal material/anode electrode 303 preferentially dissolving at its upper most region in solution and at its interface with the electrical lead, which results in the solid metal material/anode electrode 303 physically breaking and falling into the acid solution 305. This physical break electrically isolates solid metal material/anode electrode 303, thereby preventing further oxidation and metal dissolution.

Electrochemical Dissolution Systems

Figure 5:
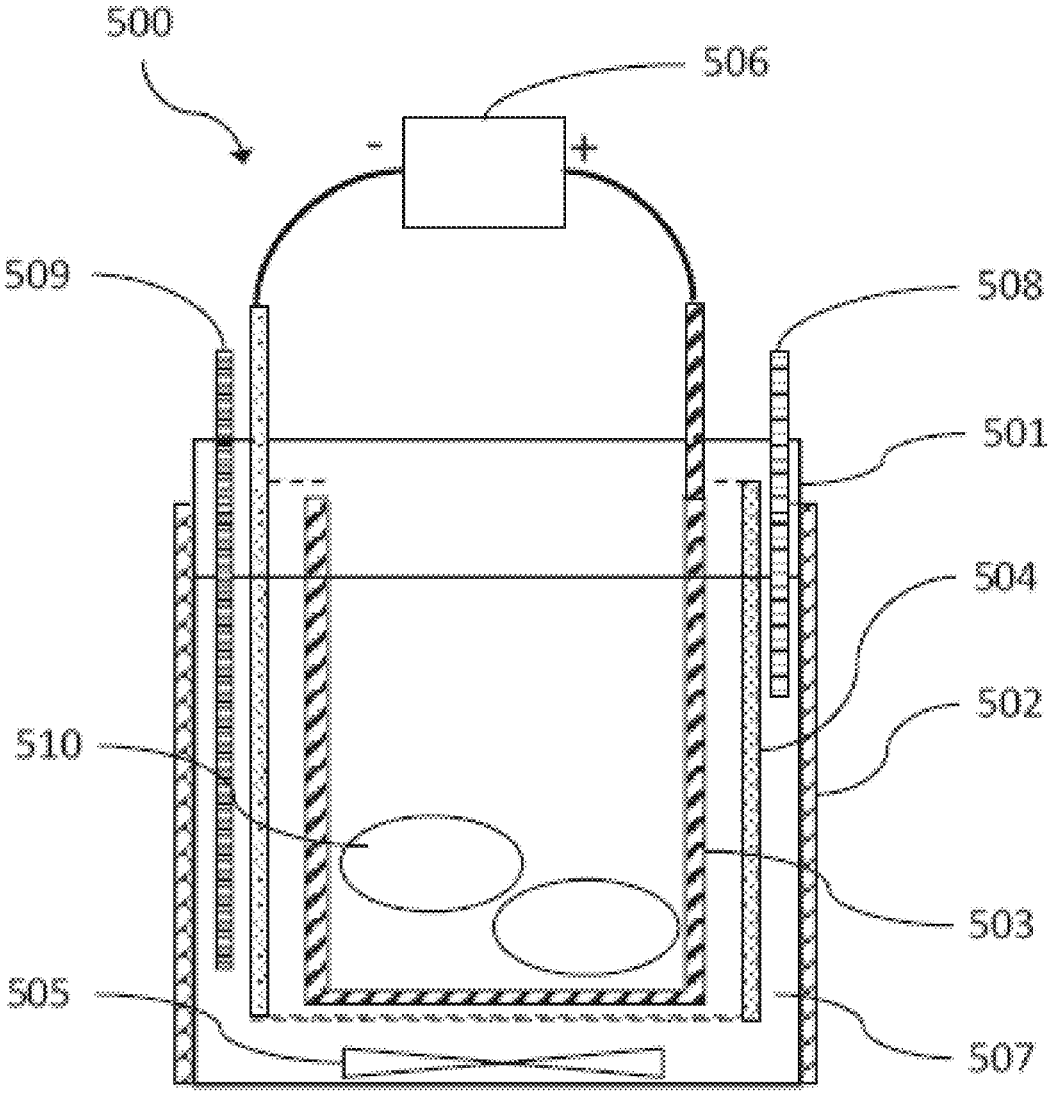
FIG. 5 illustrates an electrochemical dissolution system for dissolving metal raw materials into acid solutions according to a disclosed embodiment of the present disclosure, according to certain embodiments of the present disclosure.
Figure 6:
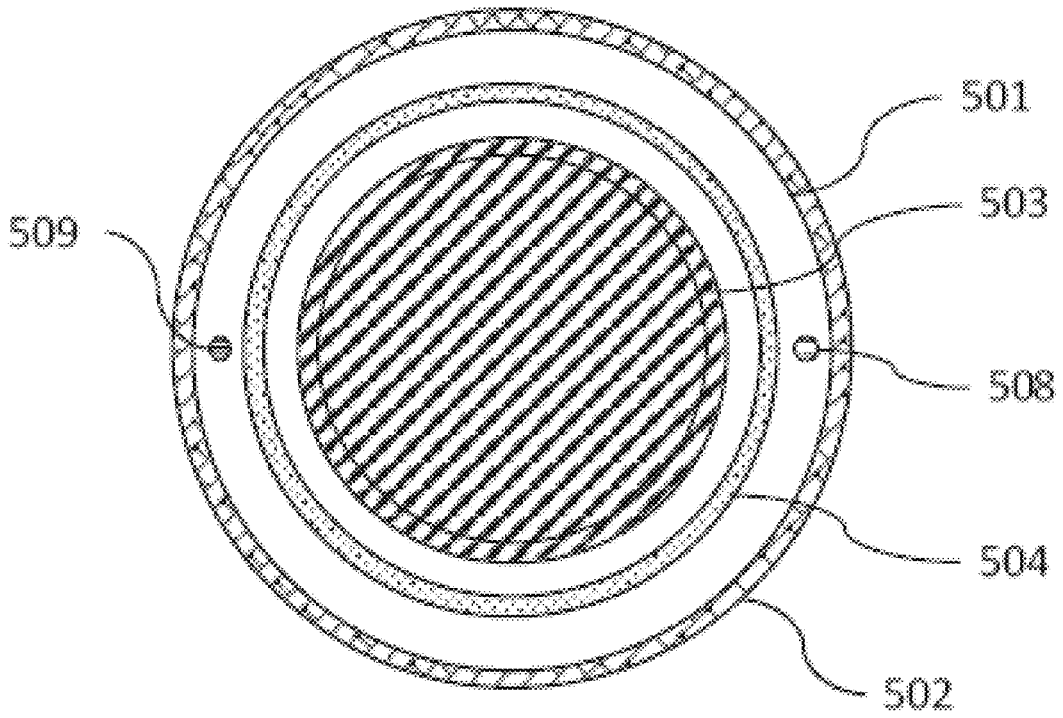
FIG. 6 illustrates an electrochemical dissolution system for dissolving metal raw materials into acid solutions according to a disclosed embodiment of the present disclosure, according to certain embodiments of the present disclosure.

FIG. 5 illustrates a cross-sectional view of an electrochemical dissolution system 500 for dissolving metal raw materials into acid solutions according to one embodiment of the present disclosure. FIG. 6 illustrates a top down view of the system shown in FIG. 5. The electrochemical dissolution system 500 of FIG. 5 and FIG. 6 includes an electrolytic bath container 501, a temperature control system 502, an anode electrode 503, a cathode electrode 504, a solution agitator 505, a power supply 506, an acid solution 507, an inlet valve 508, an outlet valve 509, and a metal raw material 510. The anode electrode 503 is positively charged and collects electrons emitted by the oxidation of the metal raw material 510 under an applied potential. The cathode electrode 504 is negatively charged and releases electrons by reducing hydrogen ions in solution to form hydrogen gas. The agitator 505 may be at least one of a mechanical agitator, magnetic stirrer, liquid circulator, or air agitator, continuously mixes the solution and removes bubbles generated during operation from the surface of the anode and cathode electrodes. Without the agitator, these generated bubbles would otherwise impede the maximum current density, and thereby the dissolution rate, by reducing available surface area on the cathode and anode electrodes. The temperature control system may be configured to maintain the solution temperature in the electrolytic bath container between 35° C. and 60° C., although other temperatures and ranges are within the scope of the present disclosure.

The electrochemical dissolution system 500 has structurally unique electrodes to maximize its metal dissolution capabilities. The anode electrode 503 is liquid permeable and is shaped as a cylindrical basket. In some embodiments, the basket is made of at least one of platinum, platinum-coated titanium, or iridium oxide-coated titanium. Furthermore, the anode electrode 503 is chemically inert and will not react with the electrolytic solution or dissolve under an applied chemical potential. The anode electrode holds and structurally suspends the metal raw material 510 in solution. The cathode electrode 504 is structured as a cylindrical sheet that equidistantly surrounds the anode electrode 503. The cathode electrode 504 may be made of at least one of platinum, platinum-coated metal, cobalt, and nickel.

The system 500 operates by solubilizing the metal raw material 510 (e.g. nickel or cobalt) via metal anodic dissolution, whereby the slow but otherwise spontaneous process of chemical dissolution is driven aggressively by the application of an applied electrical potential between anode electrode 503 and cathode electrode 504 which are submerged into the acid solution 507. In one embodiment, the anode electrode 503 does not contain the metal raw material and therefore is not electrochemically dissolved in the operation of the system. Instead, the anode electrode 503 maintains electrical contact with the power supply 506 for the duration of the reaction, which allows for the complete dissolution of the target metal material 510. Inlet 508 and outlet 509 ports are positioned on opposite sides of the electrolytic bath container and can be configured to the system allowing for continuous operation. However, it should be realized that the inlet and outlet of the system 500 may be located in different positions relative to one another and still be within the scope of the present disclosure.

As shown in the top view of FIG. 6, the anode 503 is cylindrically shaped and positioned inside of the cylindrically shaped cathode 504. Each of these components is placed within the cylindrically shaped bath container 501 that includes a heater 502. The position of the anode 503 is shown as being equidistant on all sides of its cylindrical shape from the surrounding cathode 504. As used with respect to the cathode, the term "surrounding" means that the cathode may partially or fully be formed around the anode. For example, the cathode may be a cylindrical shape that fully, or mostly, is formed around a smaller cylindrical anode. In one embodiment the cathode fully circumscribes the circumference of the anode. In another embodiment the cathode is 95%, 96%, 97%, 98%, 99% or more around the anode.

Figure 7:
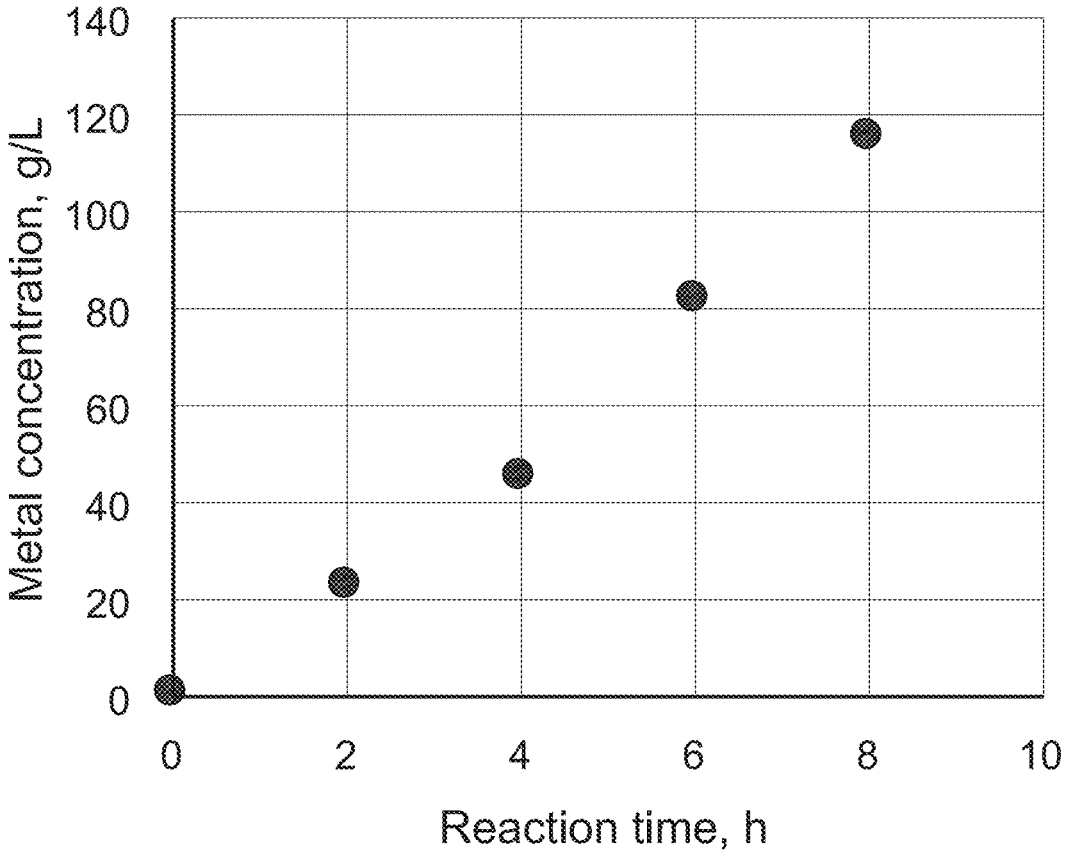
FIG. 7 illustrates operational results using systems according to embodiments of the present disclosure.

FIG. 7 illustrates typical operational results of the system shown in FIGS. 5 and 6. The metal sulfate concentration that comes from dissolution of the metal raw materials in solution increases as a function of time and can eventually achieve the solubility limit of the metal salt species in solution.

The electrochemical dissolution system 500 has operational advantages compared to the prior art system 100 of FIG. 1 and system 300 of FIG. 3. For example, it was discovered that using the electrochemical dissolution system 500 led to the metal raw material dissolving at a faster rate, leading to higher concentrations of soluble metal (e.g. nickel or cobalt) species in the resulting treated solution. In addition, the treated solution flowing out the outlet of the electrochemical dissolution system 500 had a lower residual acid concentration, would operate well at standard atmospheric pressure, and could function using a lower initial acid concentration of electrolyte.

The higher rates of metal dissolution in the electrochemical dissolution system 500 are likely to stem from the electrode design which allowed a higher active electrode surface area to contact the metal raw material, in conjunction with the close proximity of the metal species 510 to the anode electrode 503, and the close proximity of the anode electrode 503 to the cathode electrode 504. The net effect was found to reduce the resistance experienced by ion species in the acid solution 507 and thereby allow relatively high current densities and current efficiencies within the system.

Using the electrochemical dissolution system 500 allowed higher metal concentrations to be achievable because the anode electrode 503 was chemically inert and not at risk of losing electrical contact to the power supply 506. This allowed the system to operate indefinitely provided that fresh metal and acid species were continuously provided to the system in the presence of an applied electrical potential. It was discovered that the system described herein could achieve metal dissolution rates approaching 100% of the metal raw material. Lower residual acid concentrations were found as a result of achieving high utilization of the acid species 507 in the process of converting the metal raw material 510 to metal salt species within the electrolyte. This made the resulting treated acid solution immediately useful for further chemical processing as no additional pretreatment steps would be required to use the treated acid solution in later manufacturing steps.

Figure 8:
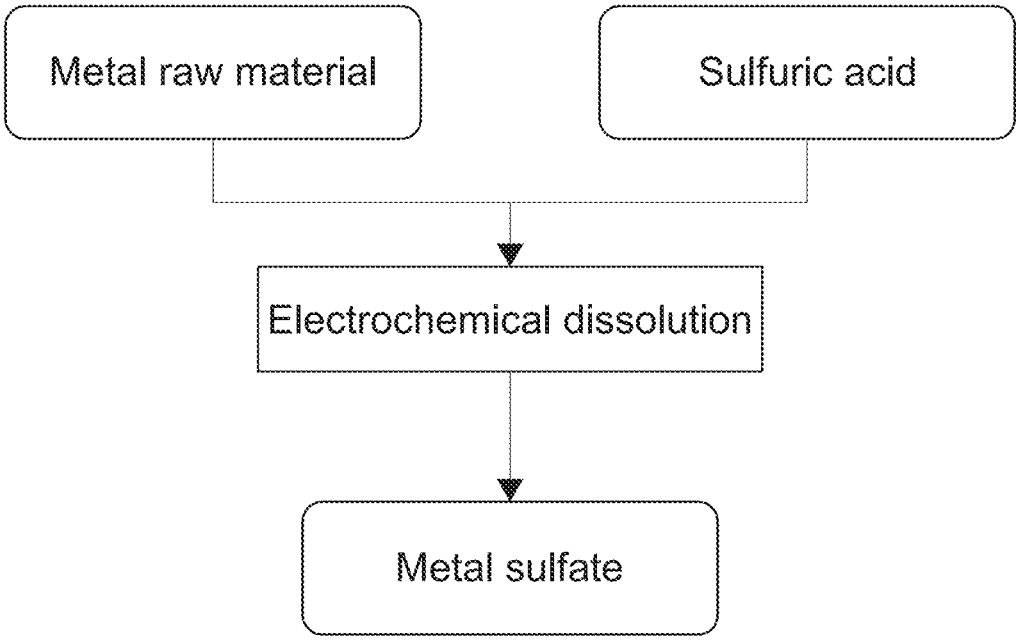
FIG. 8 is flow chart illustrating operation of an electrochemical metal dissolution system according to certain embodiments of the present disclosure.

FIG. 8 is a flow chart illustrating operation of an electrochemical metal dissolution system according to some embodiments. FIG. 8 shows that a metal raw material is combined with an acid species (shown as sulfuric acid) in a first step. Once these components are combined at the first step they can be put into the system 500 to begin an electrochemical dissolution using an applied electrical potential. Running this process leads to obtaining a metal sulfate from the metal raw material.

Figure 9:
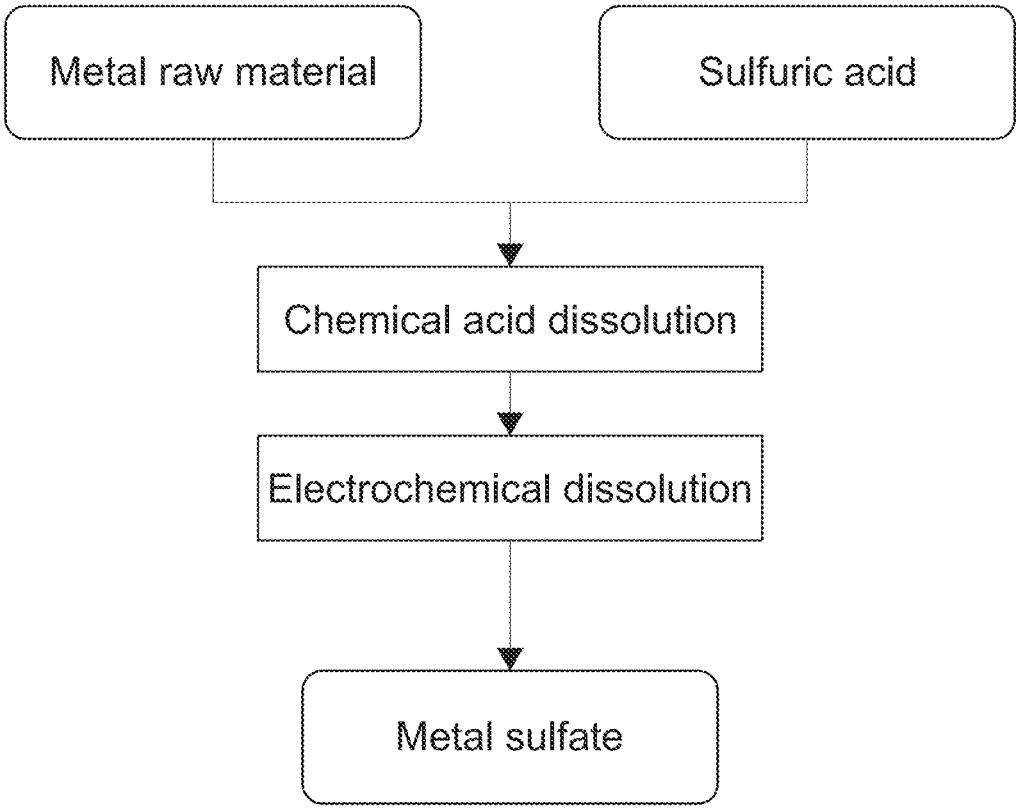
FIG. 9 is flow chart illustrating operation of an electrochemical metal dissolution system according to certain embodiments of the present disclosure.

FIG. 9 illustrates an embodiment where a chemical acid dissolution step is performed prior to the electrochemical dissolution step, relative to the process shown in FIG. 8. With reference to FIG. 9, the metal raw material is first partially dissolved chemically in the absence of an electrical potential. Once the chemical dissolution has stopped or slowed to an undesirably low value, an electrical potential is then applied to begin electrochemical dissolution, yielding a more concentrated metal sulfate salt solution.

EXAMPLES

Example 1

Table 1 below show the results of a first trial using the electrochemical dissolution system run in a constant current mode with a Ni cathode electrode nugget in a 2 M sulfuric acid electrolyte solution. This trial was used to deduce the increment drops in the weight of the Ni cathode nuggets. The final pH of the electrolyte solution was 0.07 pH. No effective deposition of Ni on the cathode was found. The overall electrical efficiency was found to be 84.0%.

TABLE 1

| Time (hr) | Voltage (V) | Current (A) | Temperature (° C.) | Ni Concentration (g/L) |
|---|---|---|---|---|
| 0 | 3 | 4.7 | 32 | 0 |
| 1 | 3 | 4.7 | 38 | 11.9 |
| 2 | 3 | 5 | 45 | 18.5 |
| 3 | 3 | 5 | 50 | 28.2 |
| 4 | 3 | 5 | 53 | 42.4 |

This example showed that over four hours at three volts, the Ni concentration within the electrolyte solution was increased from 0 g/l to 42.4 g/l.

Example 2

Table 2 show the results of a second trial using the disclosed system run in a constant voltage mode with a Ni cathode electrode nugget in a 2 M sulfuric acid electrolyte solution. This trial was used to deduce the increment drops in the weight of the Ni cathode nuggets. The final pH of the electrolyte solution is 0.22 pH. The overall electrical efficiency is 77.9%. The efficiency in each voltage cycle is about 50%. A total of 2.1 g of Ni was found to deposit on the cathode. A total of 36.9 g of Ni was dissolved in the solution.

TABLE 2

| Time (hr) | Voltage (V) | Current (A) | Temperature (° C.) | Ni Concentration (g/L) |
|---|---|---|---|---|
| 0 | — | — | 25 | 0 |
| 2 | 1.5 | 7 | 45 | 22.4 |
| 4 | 2 | 7.9 | 48 | 44.8 |
| 6 | 3 | 5.8 | 50 | 81.7 |
| 7 | 3.5 | 7.5 | 59 | 115 |

This example showed that over seven hours at 1.5 to 3.5 volts, the Ni concentration within the electrolyte solution was increased from 0 g/l to 115 g/l.

Example 3

Table 3 show the results of a third trial using the disclosed system run in a constant voltage mode at incremental variation in temperatures with a Ni cathode electrode nugget in a 2 M sulfuric acid electrolyte solution. The final pH of the solution is 0.10 pH. There was no effective deposition of Ni on the cathode. The overall electrical efficiency is 96% at 60° C. The efficiency in each cycle is at least 95%. There was found to be an increase in the Ni dissolution with increased temperatures. A total of 20.2 g of Ni was dissolved in the electrolyte solution.

TABLE 3

| Time (hr) | Voltage (V) | Current (A) | Temperature (° C.) | Ni Concentration (g/L) |
|---|---|---|---|---|
| 0 | — | — | — | 0 |
| 1 | 2.6 | 5.9 | 40 | 15.1 |
| 2 | 2.7 | 5.2 | 50 | 32.2 |
| 3 | 2.6 | 6.8 | 60 | 51.8 |

This example showed that over three hours at a constant voltage of 2.6-2.7 volts, the Ni concentration within the electrolyte solution was increased from 0 g/l to 51 g/l.

Example 4

Table 4 show the results of a fourth trial using the disclosed system run in a varying voltage mode at a constant temperatures with a Ni cathode electrode nugget in a 1 M sulfuric acid electrolyte solution. There was no deposition of Ni on the cathode found. The current drawn is lower relative to comparable trials run with a 2 M sulfuric acid electrolyte solution. The efficiency of the system was found to be very high at low voltages. Hot pockets formed on the electrodes cause electrolyte solvent evaporation. A total of 10.5 g of Ni was dissolved in the electrolyte solution.

TABLE 4

| Time (hr) | Voltage (V) | Current (A) | Temperature (° C.) | Ni Concentration (g/L) |
|---|---|---|---|---|
| 0 | — | — | 50 | 0 |
| 1 | 1.6 | 4.7 | 50 | 12.9 |
| 2 | 2.7 | 2.5 | 50 | 23.8 |

This example showed in a more dilute 1M sulfuric acid electrolyte solution over two hours at 1.6 and 2.7 volts, the Ni concentration within the electrolyte solution was increased from 0 g/l to 23.8 g/l.

Example 5

Table 5 show the results of a fifth trial using the disclosed system run in a varying voltage mode at a constant temperature with a Ni cathode electrode nugget in a 3 M sulfuric acid electrolyte solution. A high deposition of Ni was found. The current drawn was found to be much higher relative to comparable trials with 2 M sulfuric acid electrolyte solutions. The efficiency of the system was found to be very high. Hot pockets formed on the electrodes which caused electrolyte solvent evaporation. A total of 50 g of Ni was dissolved in the electrolyte solution. 1.2 g of Ni was deposited on the cathode.

TABLE 5

| Time (hr) | Voltage (V) | Current (A) | Temperature (° C.) | Ni Concentration (g/L) |
|---|---|---|---|---|
| 0 | — | — | 50 | 0 |
| 1 | 2.7 | 11 | 50 | 60 |
| 2.5 | 2.6 | 8.8 | 50 | 82 |
| 4.8 | 3.3 | 7.3 | 50 | 167 |

This example showed that in a more concentrated 3M sulfuric acid solution, over 4.8 hours at 2.7 to 3.3 volts, the Ni concentration within the electrolyte solution was increased from 0 g/l to 167 g/l.

Example 6

Table 6 shows the results of a trial using the disclosed system with a sheet of Ni metal as the cathode metal raw material in rectangular and cylindrical shapes. Table 6 demonstrates that the surface area of the cathode material directly affect the Ni dissolution, as the cathode electrode area impacts the resistance imparted by the system according to the equation shown below.

$$\text{Rate of Ni Dissolution} \propto \sqrt{\text{Area}}$$

Having maintained same operating conditions during the trial, is was understood that the resistance is imparted by the reaction coordination rather than through ohmic resistance. Furthermore, it was discovered that when the area of the cathode is reduced an increased amount of the current was directed to hydrolysis rather than for the purpose of metal dissolution.

TABLE 6

| Operating Conditions | Shape | Area ($cm^2$) | Ni (g/h) | Ni (ppm) |
|---|---|---|---|---|
| Voltage = 1.65 V<br>Current = 5.05 A<br>Temp = 50° C. | Rectangle | 94.0 | 3.6 | ~9000 |
| | Cylindrical | 356 | 6.0 | ~15000 |

Example 7

FIG. 10 shows the current v. voltage chart of a Ni briquette and FIG. 11 shows the current v. voltage chart of a Ni cathode nugget dissolved using the disclosed system. Prior to the application of a voltage between the cathode and anode, the Ni briquette was found to dissolve into solution fairly spontaneously while the Ni cathode nugget negligibly chemically dissolve. Once a voltage was applied, high currents were observed in the briquette and no pitting corrosion was observed, while the current density was relatively low in the nugget and pitting was observed at high voltages. Furthermore, while a high level of bubbling was observed with the briquette, bubbling was restricted to the initial stages with the nugget. The efficiency of the briquette dissolution was found to be 96.5%, and that of the nugget was found to be 90.6%.

Example 8

FIG. 12 shows the dissolution of a Ni briquette using the disclosed system. As seen in FIG. 12, a Ni briquette can be completely dissolved in about five hours via electrochemical methods using the system described herein with 3M sulfuric acid and at 50° C.

Example 9

FIG. 13 shows the current v. voltage characteristics for Ni electrochemical dissolution using the disclosed system with a 2 M sulfuring acid electrolyte solution at 60° C. FIG. 13 shows regions (I) an active dissolution range; (II) a passive voltage range; and (III) a transpassive region where oxygen evolution gradually begins to dominate the anodic oxidation process. Thus, it can be seen that region (I) at about 0 V to 1 V and region (III) at about 2 V to 3.5 V may be utilized for Ni electrochemical dissolution. However, region (II) between about 1 V to 2 V may not optimally dissolve Ni.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

What is claimed is:

1. An electrochemical dissolution system for dissolving raw metal materials, comprising:

an electrolyte bath container comprising a container wall and configured to hold an electrolyte solution;

a temperature control system;

a single liquid permeable anode electrode comprising an electrically conductive anode electrode body and disposed within the bath container;

a single cathode electrode continuously surrounding the single liquid permeable anode electrode equidistantly on all sides at distance of 1 mm to 2 cm; and an inlet and an outlet each positioned between the container wall and the single cathode electrode;

a power supply electrically connected to the single liquid permeable anode electrode and the single cathode electrode.

2. The electrochemical dissolution system of claim 1, further comprising an agitator configured to agitate electrolyte within the bath container.

3. The electrochemical dissolution system of claim 2, wherein the agitator comprises at least one of a mechanical agitator, a magnetic stirrer, a liquid circulator, and an air agitator.

4. The electrochemical dissolution system of claim 1, wherein the single liquid permeable anode electrode comprises a basket shape, a sandwich shape, or a tray shape.

5. The electrochemical dissolution system of claim 1, wherein the electrically conductive anode electrode body of the single liquid permeable anode electrode comprises at least one of platinum, platinum coated-titanium, and iridium coated-titanium.

6. The electrochemical dissolution system of claim 1, further comprising a metal raw material submerged within the electrolyte solution and held by the single liquid permeable anode electrode.

7. The electrochemical dissolution system of claim 6, wherein the metal raw material comprises at least one of a nickel cathode, a nickel briquette, a cobalt cathode, and a cobalt briquette.

8. The electrochemical dissolution system of claim 1, wherein the electrically conductive anode electrode body comprising at least one of a mesh type material and a punched type material.

9. The electrochemical dissolution system of claim 1, wherein the single cathode electrode comprises at least one of platinum, platinum-coated nickel, and nickel.

10. The electrochemical dissolution system of claim 1, wherein the single cathode electrode comprises a cathode electrode body comprising at least one of a corrugated material, a sponged material, and an embossed material.

11. The electrochemical dissolution system of claim 1, wherein the electrolyte bath container comprises an electrolyte.

12. The electrochemical dissolution system of claim 11, wherein the electrolyte comprises an acid.

13. The electrochemical dissolution system of claim 12, wherein the acid is sulfuric acid.

14. The electrochemical dissolution system of claim 1, wherein an acid concentration of the electrolyte solution is between 1M and 3M.

15. The electrochemical dissolution system of claim 1, wherein the electrochemical dissolution system is configured to operate at atmospheric pressure.

16. The electrochemical dissolution system of claim 1, wherein the single cathode electrode is equidistant from the single liquid permeable anode electrode at distance of 9 mm to 2 cm.

17. The electrochemical dissolution system of claim 1, wherein the system is a continuous system.

18. The electrochemical dissolution system of claim 1, wherein the system is configured to continuously flow a fresh electrolyte solution into the system and continuously discharge a processed electrolyte solution from the system.

19. A method of using the electrochemical dissolution system of claim 1, comprising:

applying a voltage between the single liquid permeable and anode electrode and the single cathode electrode;

providing a fresh electrolyte solution to the electrolyte bath container through the inlet; and withdrawing a processed solution from the electrolyte bath container through the outlet.

20. The method of claim 19, wherein the fresh electrolyte solution has a metal concentration less than the processed solution.

21. The method of claim 19, further comprising controlling the temperature of the electrolyte bath container to between 35° C. and 60° C. using the temperature control system.

22. The method of claim 19, wherein the voltage is 2.0 V to 3.5 V.

23. The method of claim 19, wherein the voltage is 0.1 V to 1 V.

24. The method of claim 19, wherein the providing the fresh electrolyte solution comprises continuously providing the fresh electrolyte solution through the inlet.

25. The method of claim 19, wherein the withdrawing the processed solution comprises continuously withdrawing the processed solution through the outlet.

* * * * *